US006276976B1

(12) United States Patent
Saito

(10) Patent No.: US 6,276,976 B1
(45) Date of Patent: Aug. 21, 2001

(54) TILT AND TRIM SYSTEM FOR OUTBOARD DRIVE

(75) Inventor: Hideki Saito, Kakegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 0 days.

(21) Appl. No.: 09/505,560

(22) Filed: Feb. 17, 2000

(30) Foreign Application Priority Data

Feb. 18, 1999 (JP) ..... 11-039789
Feb. 18, 1999 (JP) ..... 11-039797

(51) Int. Cl.[7] ..... B63H 5/125
(52) U.S. Cl. ..... 440/61
(58) Field of Search ..... 440/61

(56) References Cited

U.S. PATENT DOCUMENTS 5,032,094 7/1991 Katogi .
5,049,099 9/1991 Ito et al. .
5,149,285 9/1992 Kinoshita .
5,149,286 9/1992 Tsujii .
5,358,436 10/1994 Soda et al. .
5,529,519 * 6/1996 Nakamura et al. ..... 440/61
5,584,225 * 12/1996 Arvidsson et al. ..... 440/61
5,718,613 2/1998 Nakamura .
5,746,055 5/1998 Nakamura et al. .

* cited by examiner

*Primary Examiner*—Stephen Avila
(74) *Attorney, Agent, or Firm*—Knobbe, Martens, Olson & Bear, LLP

(57) ABSTRACT

A tilt and trim assembly for tilting an outboard drive includes an improved construction. The tilt and trim assembly has an outer cylinder defining a first internal cavity, a tilt cylinder slidably supported in the cavity and defining a second internal cavity, a tilt piston slidably supported within the second cavity and a piston rod affixed to the tilt piston and extending beyond the cavities. In one aspect, the tilt and trim assembly further has a latching mechanism to lock the tilt cylinder at the fully tilt up position. The latching mechanism includes a first engaging section defined directly at the tilt cylinder and a second engagement section defined at the outer cylinder. The tilt cylinder directly receives the tilt piston when it is placed at the deepest position. In another aspect, a lower section of the outer cylinder is thicker than an upper section thereof. A pressurizing mechanism is provided for pressuring working fluid in the cavities and has a powering assembly therein. The powering assembly is disposed in proximity to the upper section of the outer cylinder.

35 Claims, 13 Drawing Sheets

TILT AND TRIM SYSTEM FOR OUTBOARD DRIVE

BACKGROUND OF THE INVENTION

1. Field of the Invention

This invention relates to watercraft with an outboard drive, and more particularly to an improved tilt and trim system for an outboard drive.

2. Description of Related Art

In many types of marine propulsion systems such as outboard motors, there is provided a hydraulic cylinder assembly that is interposed between the outboard drive of the propulsion system and the watercraft transom. The hydraulic cylinder assembly provides a number of purposes. For instance, the hydraulic assembly is employed for tilting and trimming the outboard drive. The tilt movement is accomplished to tilt up the drive unit out of the water when it is not in use or for other purposes such as maintenance or inspection, etc. and tilt down the drive unit from the tilted up position. The trim movement is accomplished to trim up or down the drive unit for adjusting positions of the associated watercraft in response to speed thereof.

Obviously, in order to permit trimming when operating under power, the hydraulic cylinder assembly must provide large force. This can be easily accomplished by providing relatively large effective piston areas over which the hydraulic pressure operates. However, these types of mechanisms, although providing good hydraulic force for the trim operation, are very slow in the tilt up operation.

Therefore, it has been proposed to employ one trim fluid motor to provide the trim adjustment. This trim fluid motor has a relatively large diameter piston and, thus, has a relatively low stroke for a given fluid displacement In addition, a smaller bore, but longer stroke, tilt fluid motor is also coupled to the outboard drive for effecting the tilt up operation. Thus, high speed tilting can be accomplished without loss of power for the trim operation. However, the outboard drive only permits a small space between the outboard drive and the watercraft transom to employ fluid motors.

There have been proposed, therefore, telescopic or compound hydraulic cylinder assemblies wherein single external cylinders are provided. A tilt cylinder is slidably supported in an outer cylinder defining an internal cavity in which a tilt piston is movable. Basically, these assemblies operate by effecting hydraulic pressure actuation of both the trim and tilt cylinders simultaneously for a portion of the stroke during which trim movement is accomplished. The tilt cylinder is then held and the tilt piston, which has a smaller effective piston area, is operated for tilt up operation.

As is readily understood, a range for the trim movement exists below a range for the tilt movement. The drive unit moves from a fully trimmed down position to a fully trimmed up position within the trim range and then moves from the fully trimmed up position to a fully tilted up position within the tilt range. The drive unit moves back from the fully tilted up position to the fully trimmed down position by conversely tracing the moving up operation. These sequences must be strictly held for systematic operation of the hydraulic system. That is, in the moving up operation, the trim movement must precede and then the tilt movement follows. Meanwhile, in the moving down operation, the tilt movement must precede and then the trim movement follows. In order to prevent inverse operations from occurring, the hydraulic system usually employs specific mechanisms. A latching mechanism is provided, as one of the mechanisms, to hold the tilt cylinder in a fully trimmed up position during the tilt down movement.

Also, a piston rod which extends from the tilt piston supports the drive unit. The drive unit has a relatively heavy weight The piston rod and then the tilt piston, must receive the weight and shock, i.e., reaction force of the drive unit. Since the tilt cylinder slidably supports the tilt piston therein, ultimately the tilt cylinder needs a section for receiving the reaction force therein.

U.S. Pat. Nos. 5,718,613 and 5,746,055 disclose latching mechanisms and reaction force receiving members. However, they are provided separately with each other and hence constructions of the cylinder assemblies are somewhat complicated. More neat and simple arrangement, therefore, is desired. In addition, the reaction force is received by snap rings provided in these cylinder assemblies. Although the snap rings are generally sufficient to receive such force, it is desirable to receive them by a member which is more rigid than the snap ring in case of a relatively large force exerting upon the member.

It is, therefore, a principal object of the present invention to provide a telescopic hydraulic system that has a latching mechanism and a reaction force receiving section in more simple and neat fashion, and also a relatively large reaction force can be received more than enough.

The telescopic cylinder assembly of the hydraulic system is conventionally disposed off to the side from the axis of the bracket assembly because, for example, a relatively large electric motor that activates a fluid pump delivering working fluid is parallelly placed on the other side of the axis of the bracket assembly. However, this arrangement is not always suitable for every outboard motor due to concentration of stress. The cylinder assembly is desirably disposed on the axis of the bracket assembly or as near as possible. In this improved arrangement, however, space for a component such as an electric motor is quite limited. Particularly, if the telescopic cylinder has a lower portion thicker than an upper portion, this problem is serious.

It is, therefore, another object of the present invention to provide a cylinder assembly that can be disposed on the axis of the bracket assembly or as near as possible, even if its lower portion is thicker than the upper portion thereof.

Also, the hydraulic cylinder assembly needs a fluid conduit that is arranged to deliver the working fluid to the second internal cavity defined in the tilt cylinder. Since the fluid conduit is desired to be joined at the uppermost position of the tilt cylinder, conventionally this fluid conduit is disposed within the upper space. The upper space, therefore, is reduced by the conduit to a greater or less extent.

It is, therefore, a further object of the present invention to provide a telescopic hydraulic system that has no conduit within the upper space.

SUMMARY OF THE INVENTION

In accordance with one aspect of the present invention, a telescopic tilt and trim hydraulic system for a watercraft and an outboard drive comprises an outer cylinder adapted to be affixed to one of the watercraft and the outboard drive and defining a first internal cavity. A tilt cylinder is sidably supported within the first internal cavity and defines a second internal cavity. A tilt piston is slidably supported within the second internal cavity. A piston rod is affixed to the tilt piston and extends beyond the internal cavities for attachment to the other of the outboard drive and the watercraft. A pressurizing mechanism is arranged to selectively pressurize working fluid within the first cavity and the second cavity for causing reciprocal movement of the tilt cylinder for effecting trim adjustment of the outboard drive and reciprocal movement of the tilt piston for effecting tilt movement of the outboard drive. A latching mechanism is arranged to latch the tilt cylinder at generally a fully tilted up position. The latching mechanism includes a first position in which it moves with the tilt cylinder and a second position in which it latches the tilt cylinder to the outer cylinder. The tilt cylinder directly receives the tilt piston when the tilt piston is placed at generally its fully retracted position with respect to the tilt cylinder.

In accordance with another aspect of the present invention, a telescopic tilt and trim hydraulic system for a watercraft and an outboard drive comprises an outer cylinder adapted to be affixed to the watercraft and defining a first internal cavity. The outer cylinder includes an upper section and a lower section. The lower section is thicker than the upper section of the outer cylinder. A tilt cylinder is slidably supported within the first internal cavity and defines a second internal cavity. A tilt piston is slidably supported within the second internal cavity. A piston rod is affixed to the tilt piston and extends beyond the internal cavities for attachment to the outboard drive. A pressurizing mechanism is arranged to selectively pressurize working fluid within the first cavity and the second cavity for causing reciprocal movement of the tilt cylinder for effecting trim adjustment of the outboard drive and reciprocal movement of the tilt piston for effecting tilt movement of the outboard drive. The pressurizing mechanism includes a powering assembly. The powering assembly is disposed in proximity to the upper section of the outer cylinder.

In accordance with a further aspect of the present invention, a telescopic tilt and trim hydraulic system for a watercraft and an outboard drive comprises an outer cylinder adapted to be affixed to one of the watercraft and the outboard drive and defining a first internal cavity. A tilt cylinder is slidably supported within the first internal cavity and defines a second internal cavity. A tilt piston is slidably supported within the second internal cavity. A piston rod is affixed to the tilt piston and extends beyond the internal cavities for attachment to the other of the outboard drive and the watercraft. A pressurizing mechanism is arranged to selectively pressurize working fluid within the first cavity and the second cavity for causing reciprocal movement of the tilt cylinder for effecting trim adjustment of the outboard drive and reciprocal movement of the tilt piston for effecting tilt movement of the outboard drive. The pressurizing mechanism includes at least one fluid passage defined between the tilt cylinder and the upper section of the outer cylinder. The fluid passage communicates with both of the first cavity and the second cavity.

In accordance with a still further aspect of the present application, a power tilt and trim adjustment mechanism for an outboard drive comprises a support member that couples to the outboard drive. The support member includes a pair of bracket arms spaced from each other. A center axis of the support member extends therein with generally the same distances from the bracket arms. An actuator has an axis along which at least one actuator element reciprocates. The axis of the actuator is off set from the center axis of the support member. The actuator is nested between the bracket arms. A powering assembly is arranged next to an upper portion of the actuator.

In accordance with a yet further aspect of the present invention, a telescopic hydraulic system comprises an outer cylinder member. An inner cylinder member is slidably supported in the outer cylinder member. The outer cylinder member and the inner cylinder member together define at least one variable volume chamber with reciprocal movement of the inner cylinder member within the outer cylinder member. A fluid passage is formed on at least one of abutting walls of the outer cylinder member and the inner cylinder member. A powering unit supplies a working fluid to the variable volume chamber through the fluid passage.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

DETAILED DESCRIPTION OF THE PREFERRED EMBODIMENTS

Figure 1:
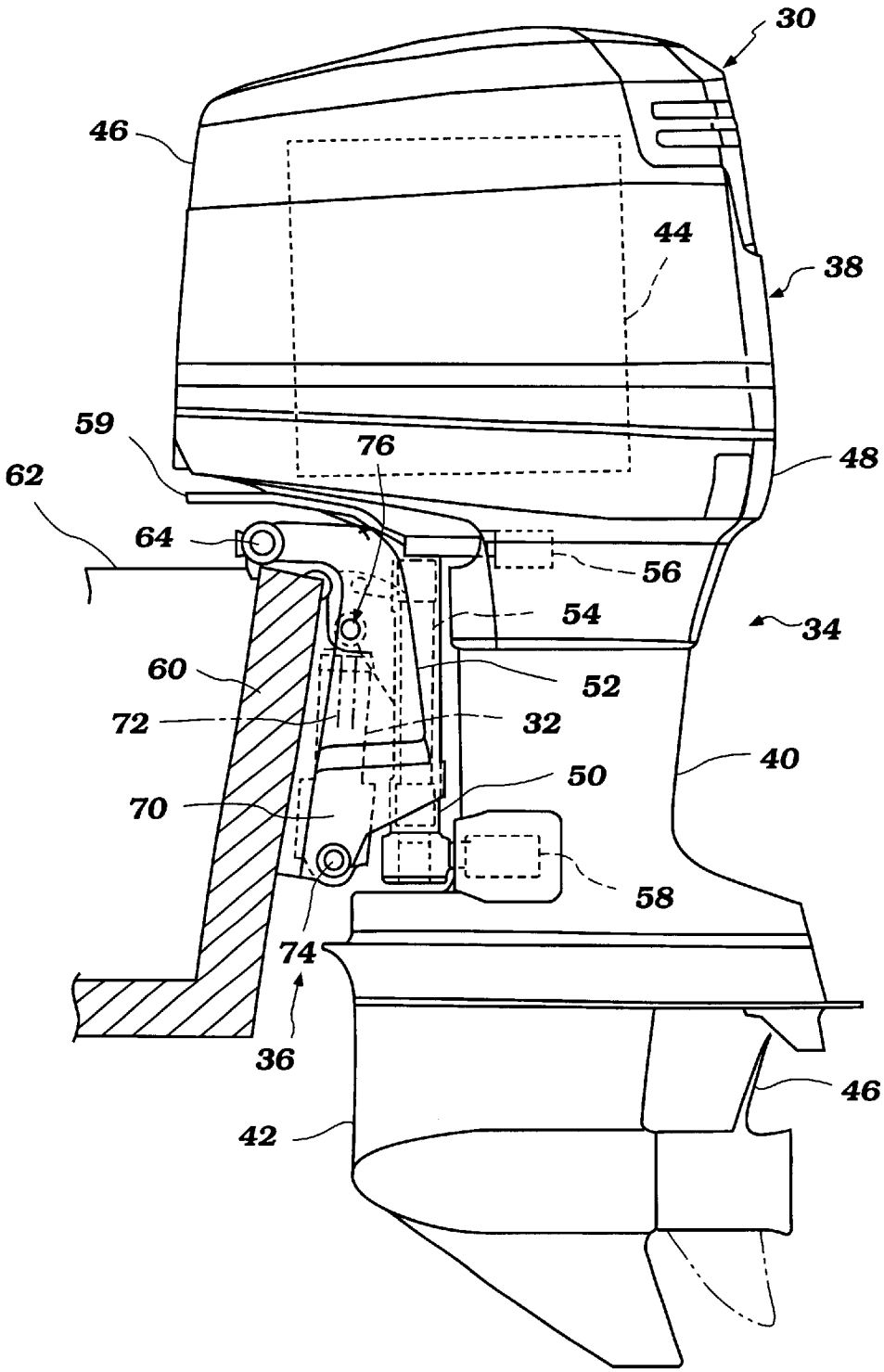
FIG. 1 is a side elevational view showing an outboard motor that can employ a telescopic tilt and trim hydraulic system in accordance with a preferred embodiment of this invention. An associated watercraft is sectioned in part. A drive unit of the outboard motor is placed at a fully trimmed down position.
Figure 2:
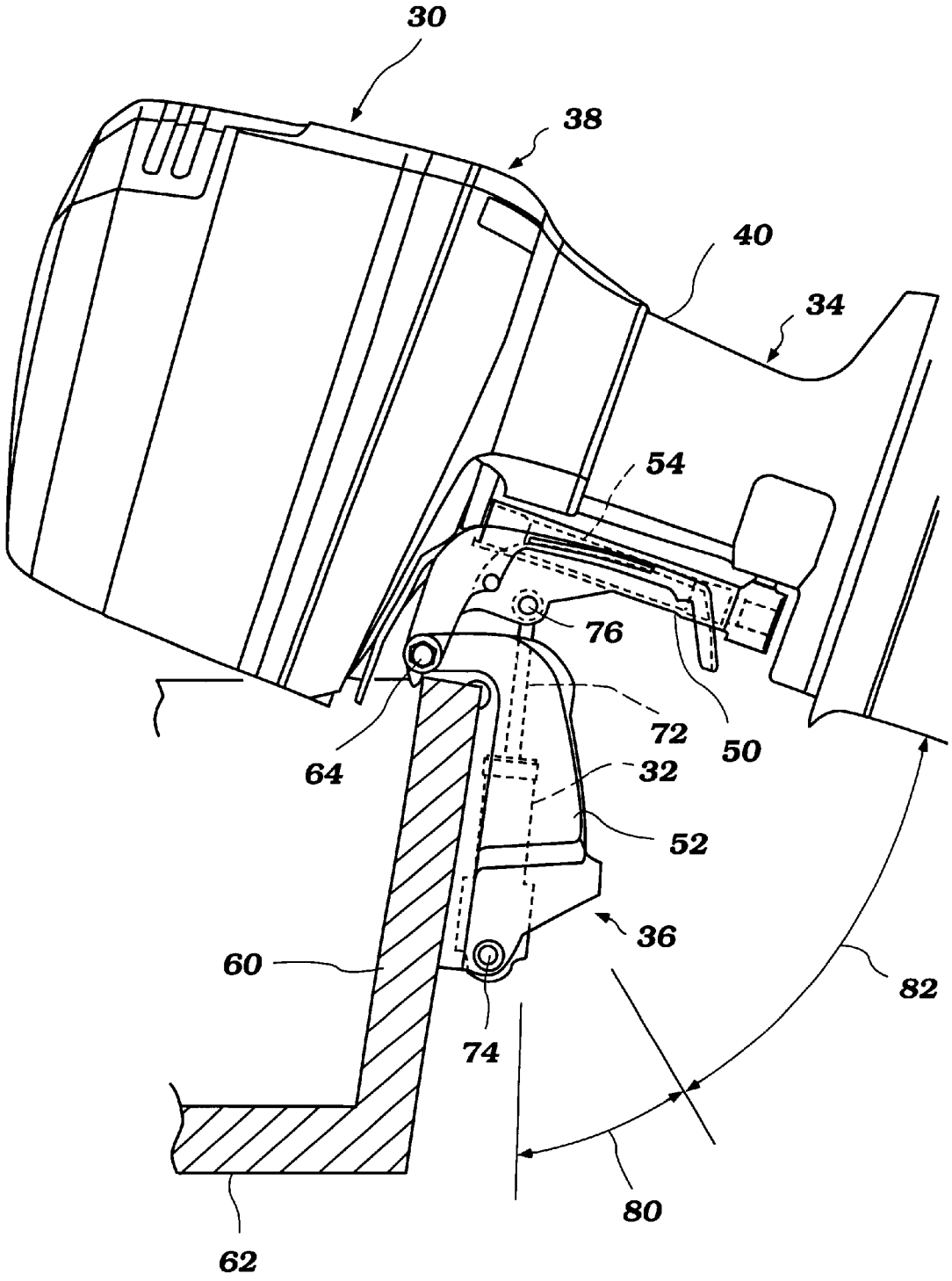
FIG. 2 is a side elevational view of the apparatus of FIG. 1, showing the drive unit in a fully tilted up position.

With reference to FIGS. 1 and 2, an outboard motor, designated generally by reference numeral 30, includes a telescopic tilt and trim hydraulic system 32. Although the present invention is shown in the context of an outboard motor, various aspects and features of the present invention also can be employed with other types of outboard drives (e.g., a stern drive unit).

In the illustrated embodiment, the outboard motor 30 comprises a drive unit 34 and a bracket assembly 36. The drive unit 34 includes a power head 38, a driveshaft housing 40 and a lower unit 42. The power head 38 is disposed atop of the drive unit 34 and includes an internal combustion engine 44, top protecting cowling 46 and bottom protecting cowling 48. The engine 44 powers a propulsion device of the outboard motor 30. Although not shown, the engine 44 has an output shaft or a crankshaft extending generally vertically. The top and bottom cowlings 46, 48 generally completely enclose the engine 44. The top cowling 46 is detachably affixed to the bottom cowling 48 to permit access to the engine for maintenance or other purposes.

The driveshaft housing 40 depends from the power head 38 and supports a driveshaft which is driven by the output shaft of the engine. The driveshaft extends generally vertically through the driveshaft housing 40.

The lower unit 42 depends from the driveshaft housing 40 and supports a propeller shaft which is driven by the driveshaft. The propeller shaft extends generally horizontally through the lower unit 42. In the illustrated embodiment, the propulsion device includes a propeller 46 that is affixed to an outer end of the propeller shaft and is driven by the propeller shaft. A bevel gear transmission couples the two shafts which lie generally normal to each other (i.e., at a 90° shaft angle). The transmission has a switchover mechanism to shift rotational directions of the propeller 46 to forward, neutral or reverse.

The bracket assembly 36 comprises a swivel bracket 50 and a clamping bracket 52. The swivel bracket 50 supports the drive unit 34 for pivotal movement about a generally vertically extending axis, i.e., an axis of steering shaft 54. The steering shaft 54 extends through a shaft housing of the swivel bracket 50 and both ends of the steering shaft 54 are affixed to the driveshaft housing by an upper mount assembly 56 and a lower mount assembly 58. A steering section 59 extends slightly upwardly and then forwardly from the steering shaft 54 to be steered in a manner which is well known. For instance, a push-pull cable is provided between the steering section 59 and a steering wheel which is located in proximity to a control panel of the associated watercraft 62 to swing the steering section 59. The clamping bracket 52, in turn, is affixed to a transom 60 of an associated watercraft 62 and supports the swivel bracket 50 for pivotal movement about a generally horizontally extending axis, i.e., an axis of a tilt shaft 64.

As used through this description, the terms "front," "forward" and "forwardly" mean at or to the side where the clamping bracket 52 is positioned and the terms "reverse," "rear," and "rearwardly" mean at or to the opposite side of the front side, unless indicated otherwise.

The telescopic tilt and trim hydraulic system 32 is provided between the swivel bracket 50 and the clamping bracket 54. Although a structure of this hydraulic system 32 will be described more definitely shortly, it has an outer cylinder 70 that defines an internal cavity. A piston is slidably contained in the cavity. A piston rod 72 is affixed to the piston and extends beyond the cavity. The lower end of the outer cylinder 70 is affixed to the clamping bracket 52 for pivotal movement about a generally horizontally extending axis, i.e., an axis of a pivotal shaft 74. The top end of the piston rod 72 is affixed to the swivel bracket 50 for pivotal movement about a generally horizontally extending axis, i.e., an axis of another pivotal shaft 76. The internal cavity is filled with working fluid which is pressurized by a pressurizing mechanism which will be described shortly.

Because the piston is slidable in the internal cavity of the outer cylinder 70, the piston rod 72 is reciprocally movable to lift and lower the swivel bracket 50. With this movement of the swivel bracket 50, the drive unit 34 is trimmed up and down within a trim adjusted range 80 and further tilted up and down within a tilt range 82. The propeller 46 is submerged when the drive unit 34 moves within the trim adjusted range 80 and it comes out from the water surrounding the outboard motor 30 when the drive unit 34 moves within the tilt range 82. FIG. 1 illustrates that the drive unit 34 is in a fully trimmed down position, while FIG. 2 illustrates that the drive unit 34 is in a fully tilted up position.

When the drive unit 34 is moved within the trim adjusted range 80 under a forwarding condition of the associated watercraft 62, positions of the watercraft 62 is trimmed up and down. A trimmed up position of the watercraft 62 is suitable for a high speed running, while a trimmed down position thereof is appropriate for a low speed running.

The drive unit 34 is moved within the tilt range 82 usually when the associated watercraft 62 is at a standstill. The operator can inspect or check the outboard motor 30, particularly the engine 44, during a stay of the drive unit 34 at this tilted up position. Occasionally, however, the drive unit 34 is moved up to this tilt range 82 when the outboard motor 30 advances in the shallow water.

Because the drive unit 34 should move within the trim adjusted range 80 under the water and under a running condition, the hydraulic system 32 needs a relatively large force to trim it up or down but the system 32 need not provide high speed operation. However, it is desirable that hydraulic system 32 provide high speed operation rather than powerful activation of the drive unit 34 within the tilt range 82. The hydraulic system 32 has a telescopic cylinder assembly or actuator 90, as described with reference to FIGS. 3 to 8 and 11.

Figure 11:
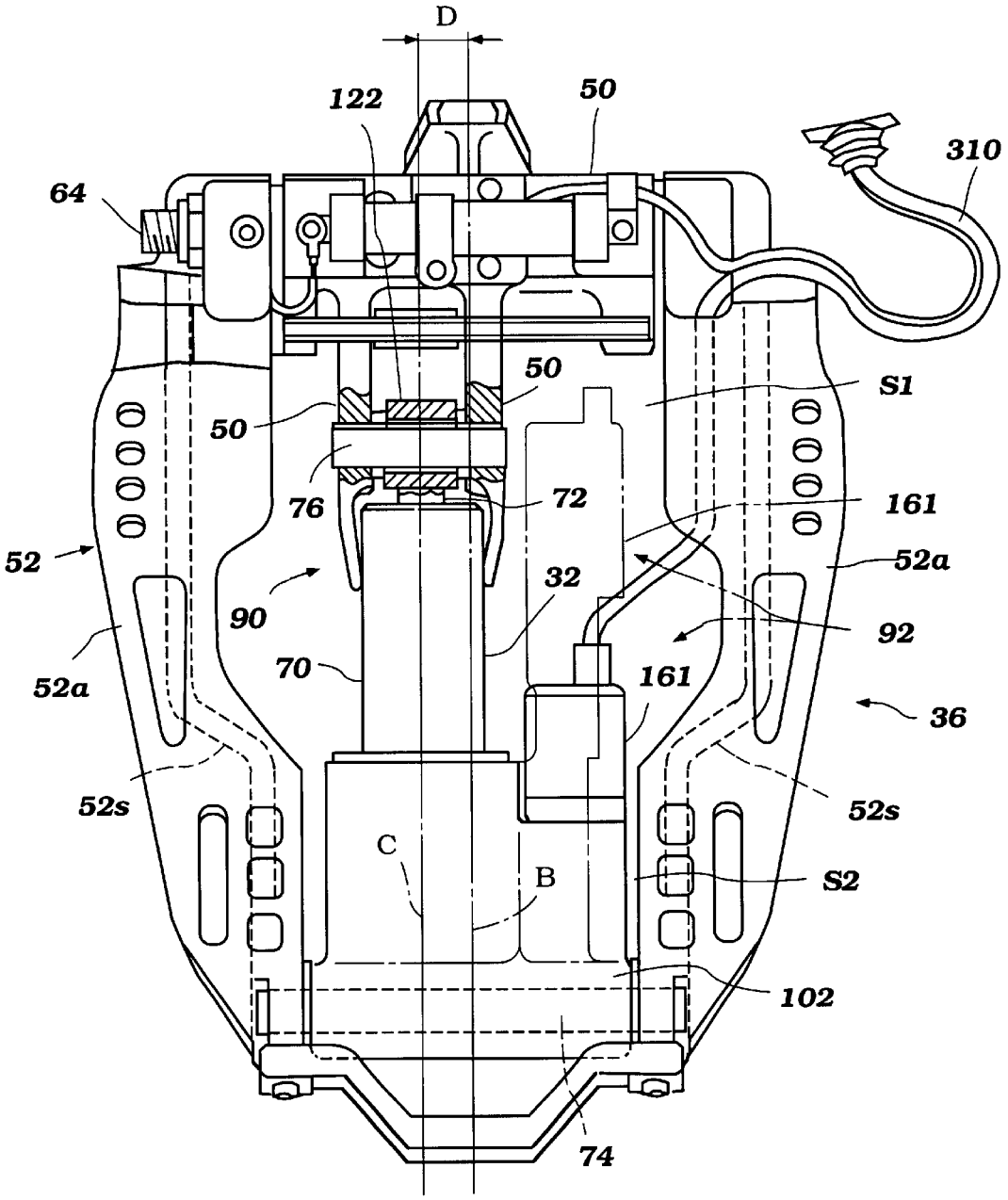
FIG. 11 is a front view showing a bracket assembly including the telescopic tilt and trim hydraulic system. A pressurizing mechanism in accordance with the first embodiment of the present invention is indicated in phantom, while another pressurizing mechanism in accordance with a second embodiment of the present invention is indicated in actual line.
Figure 12:
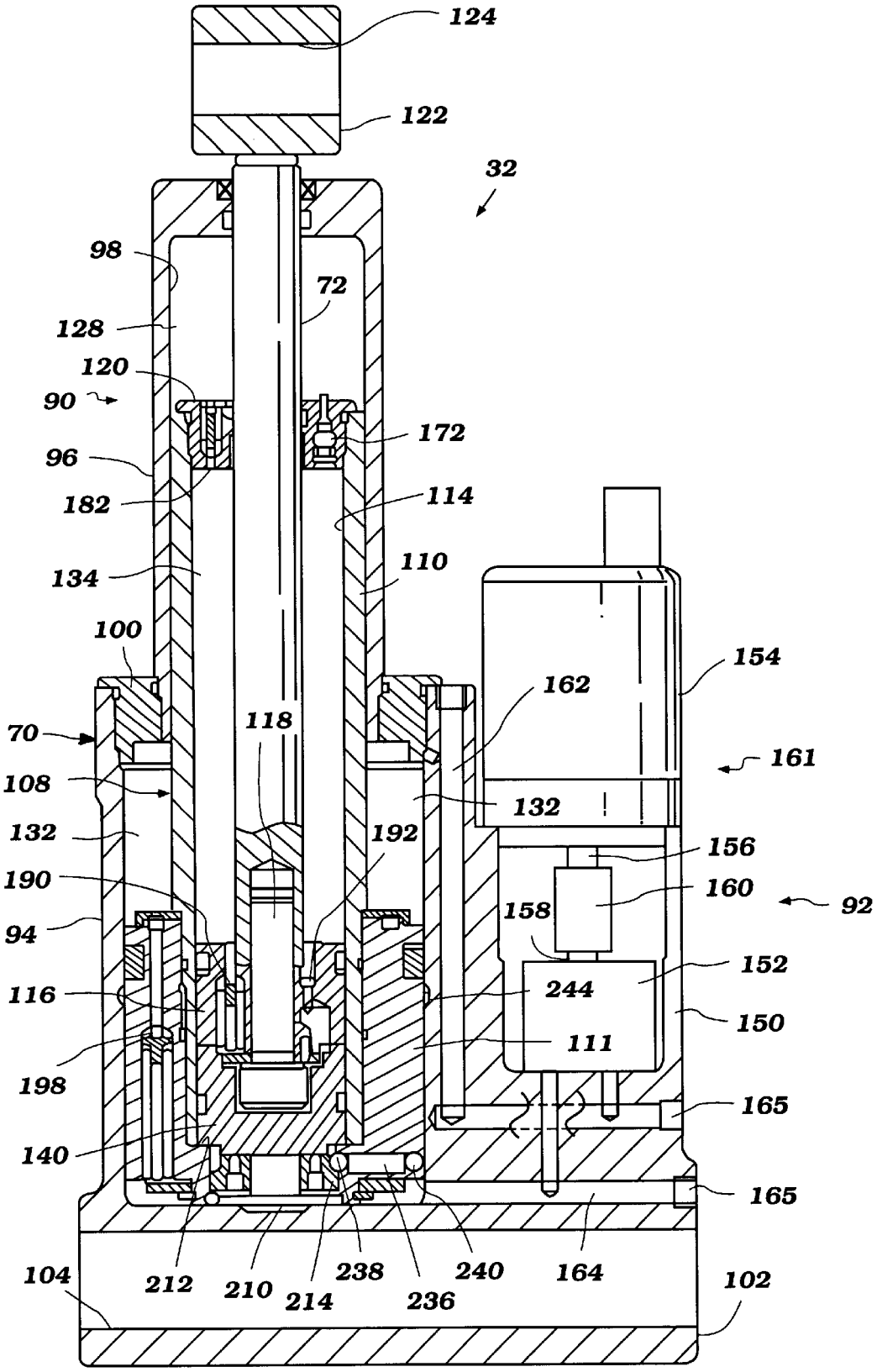
FIG. 12 is an enlarged cross-sectional front view showing a telescopic tilt and trim hydraulic system in accordance with a second embodiment of the present invention. The system is in a fully trimmed down position.
Figure 13:
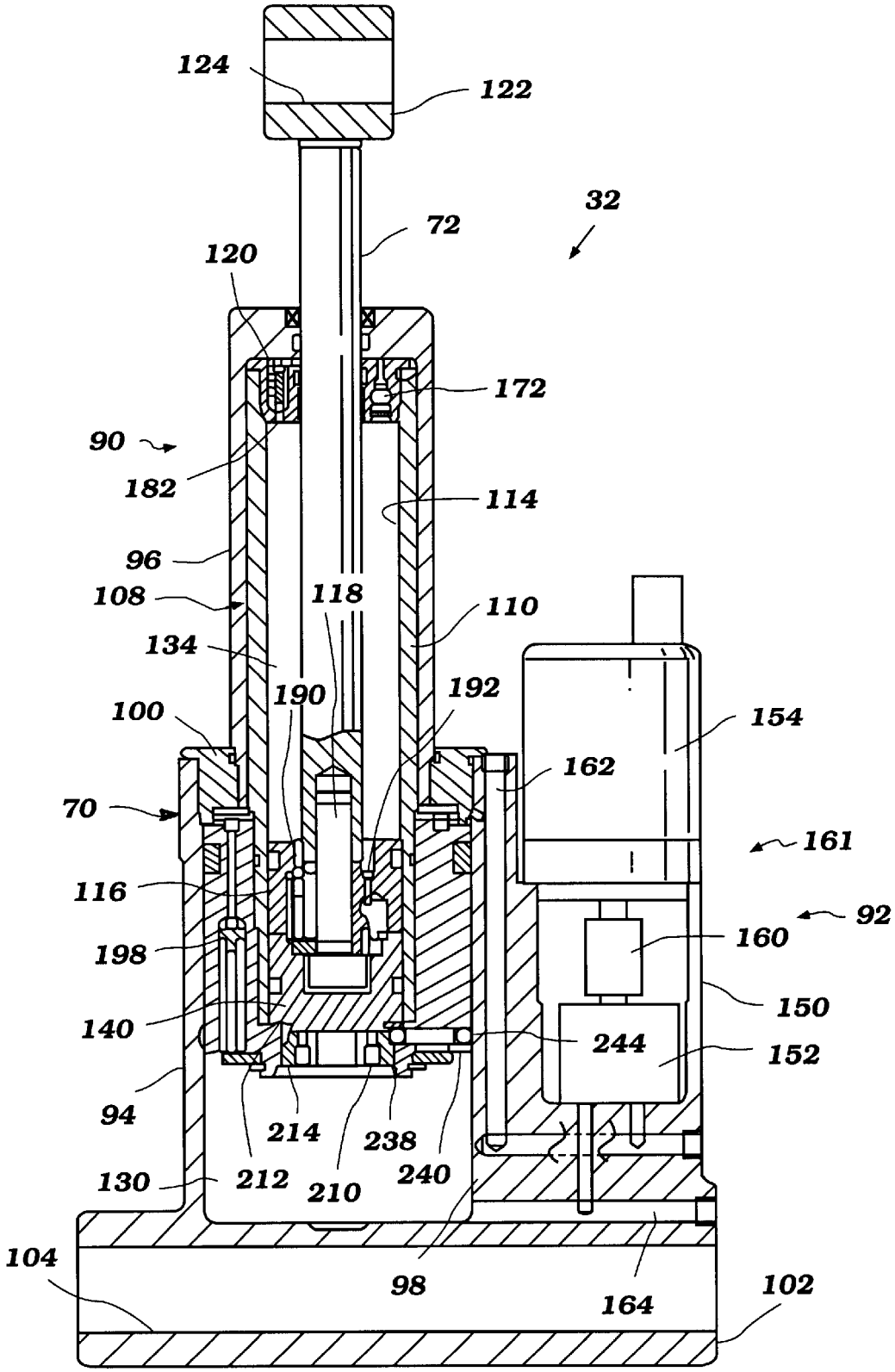
FIG. 13 is a front view showing the system of FIG. 12 in a fully trimmed up position.
Figure 14:
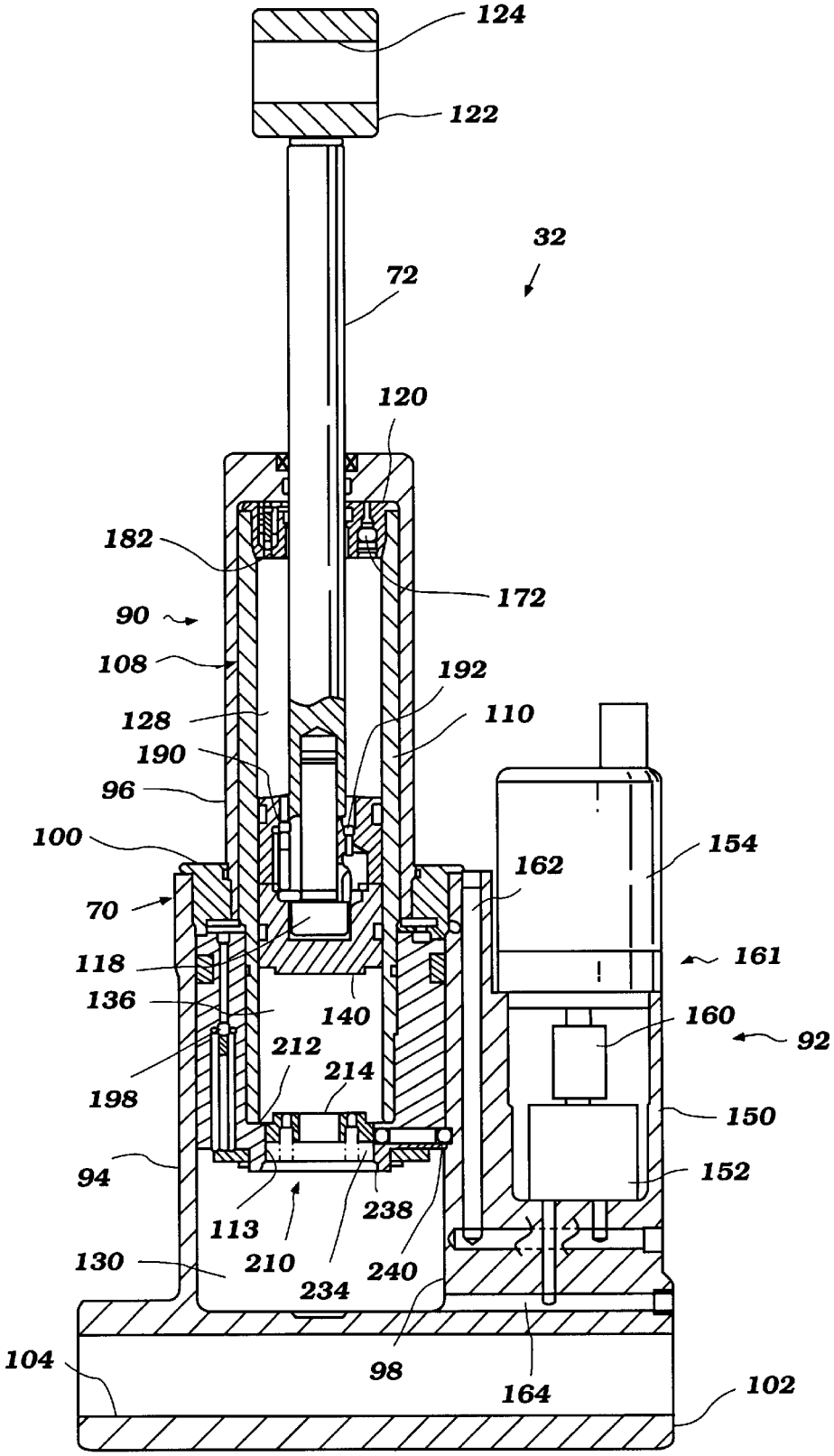
FIG. 14 is a front view showing the system of FIG. 12 in a midway from the fully trimmed up position to a fully tilted up position.
Figure 15:
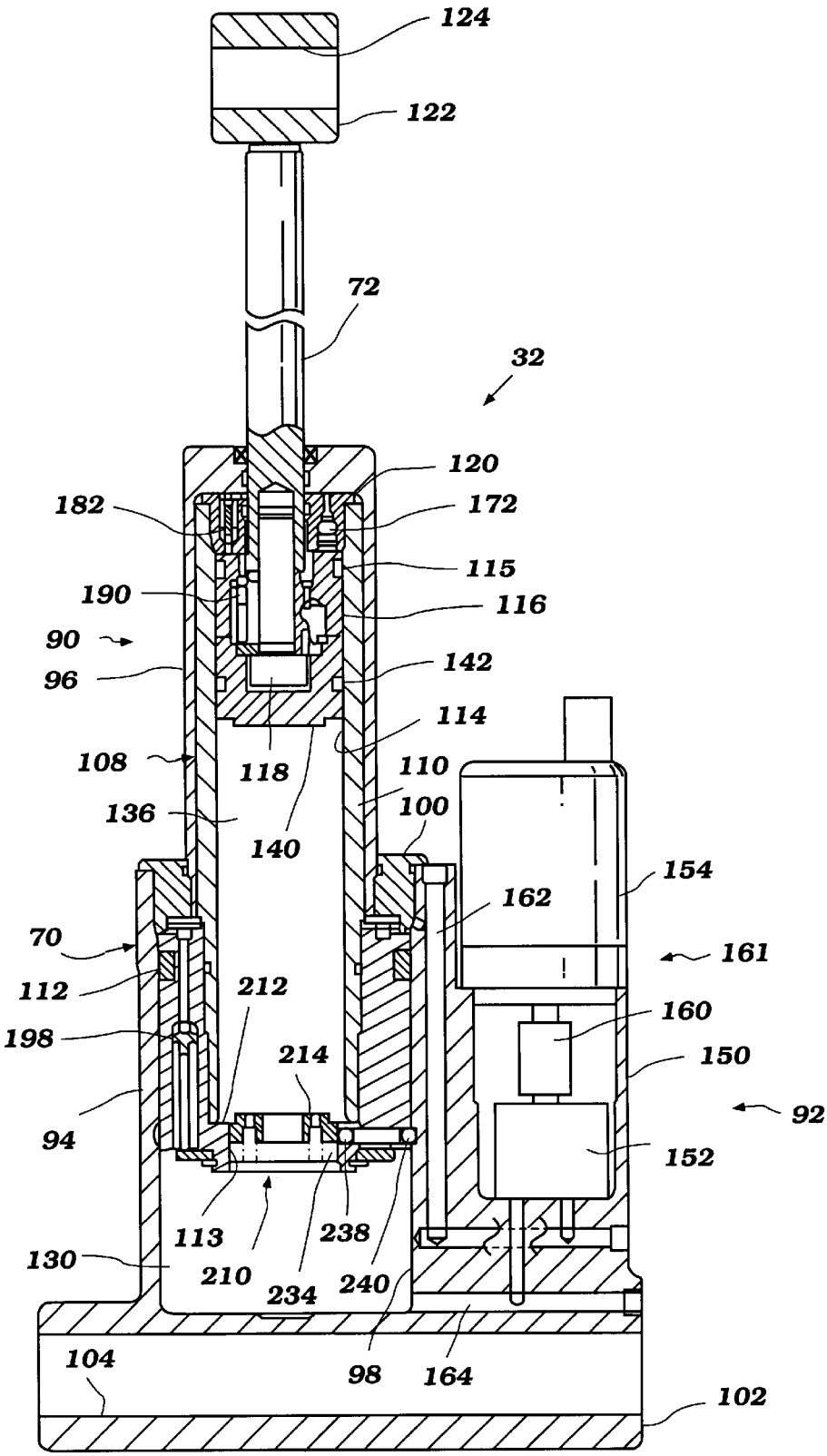
FIG. 15 is a front view showing the system of FIG. 12 in a fully tilted up position.

As seen in FIG. 11, the telescopic tilt and trim hydraulic system 32 comprises the telescopic cylinder assembly 90 and the pressurizing mechanism 92. Two arrangements of the pressurizing mechanism 92 are shown in this figure, one in phantom and the other in actual line. The arrangement in phantom indicates the first embodiment of the present invention.

In the illustrated arrangement, the telescopic cylinder assembly 90 is nested between a pair of bracket arms 52*a* of the clamping bracket 52. An axis C of the cylinder 90 along which the piston rod 72 reciprocates is off set to one side (the left hand side in FIG. 11) with a distance D from a center axis B of the bracket assembly 36 as shown in FIG. 11. The center axis B extends with equal distances from both of the bracket arms 52*a*. However, of course, the cylinder axis C can be disposed aligned with the bracket axis B. Each bracket arm 52*a* has a standing section 52*s*. Upper portions of the standing sections 52*s* are spaced farther from each other than lower portions thereof. That is, a space S1 between the upper portions of the standing sections 52*s* is greater than a space S2 between the lower portions thereof.

The telescopic cylinder 90 includes the outer cylinder 70. As seen in FIGS. 3 to 6, the outer cylinder 70 is formed with a lower cylinder section 94 and an upper cylinder section 96 which has a smaller diameter than the lower cylinder section 94. In other words, the lower cylinder section 94 has a larger diameter than the upper cylinder section 96. The lower cylinder section 94 is unified with a body of the pressurizing mechanism 92. The outer cylinder 70 has a first internal cavity 98 that is defined in both of the lower and upper cylinder sections 94, 96. The cavity portion in the upper cylinder section 96 has a diameter smaller than a diameter of the cavity portion of the lower cylinder section 94. A circular cap 100 completes the outer cylinder 70 and is provided atop of the cavity portion of the lower cylinder section 94 to plug an opening formed between the uppermost portion of the lower cylinder section 94 and the lowermost portion of the upper cylinder section 96. The outer cylinder 70 has a boss 102 at the bottom portion of the lower cylinder section 94. The pivot shaft 74 of FIG. 2 extends through an opening 104 of the boss 102.

Figure 5:
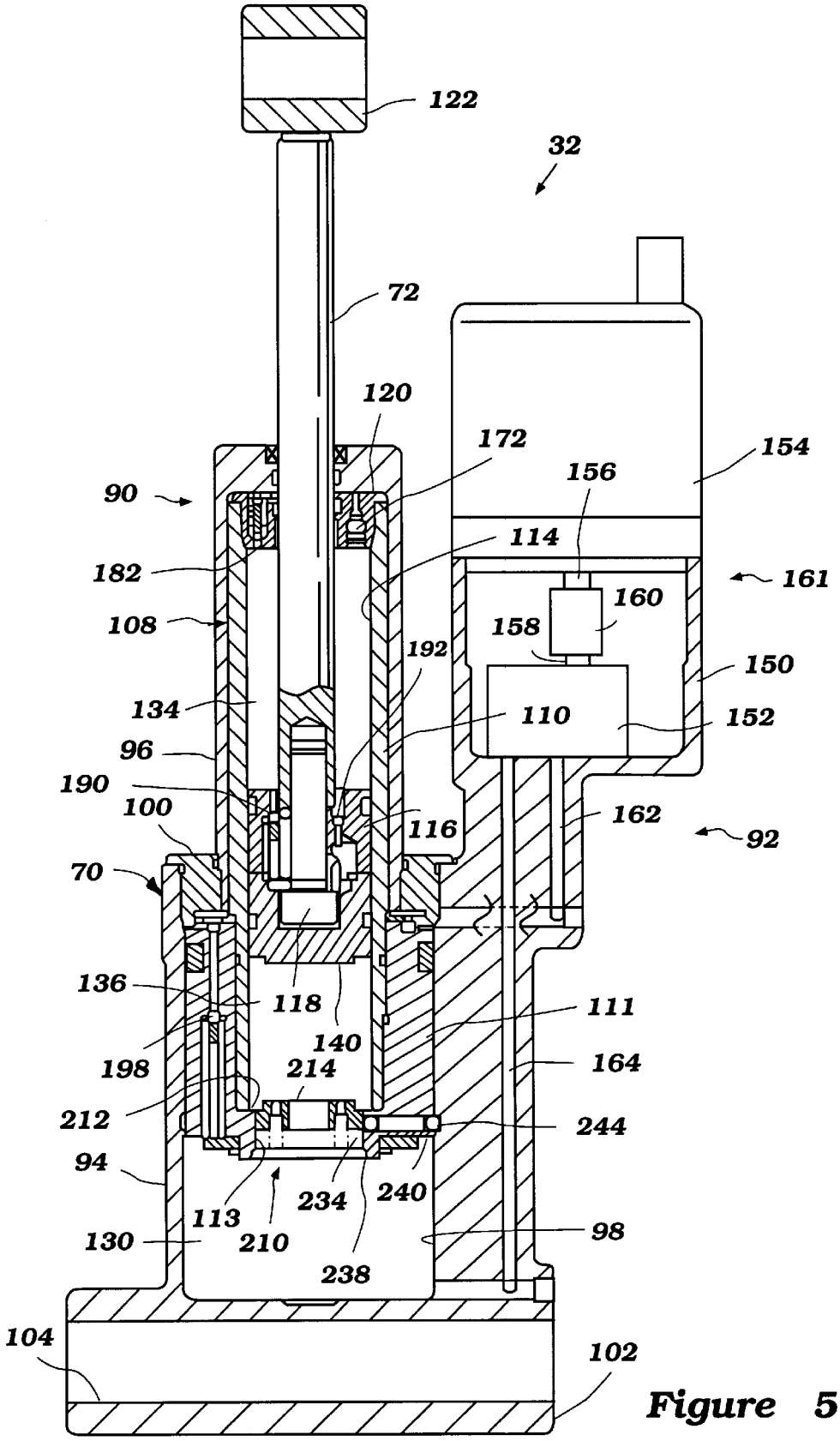
FIG. 5 is an enlarged cross-sectional front view showing the system of FIGS. 3 and 4 midway between the fully trimmed up position and a fully tilted up position.
Figure 6:
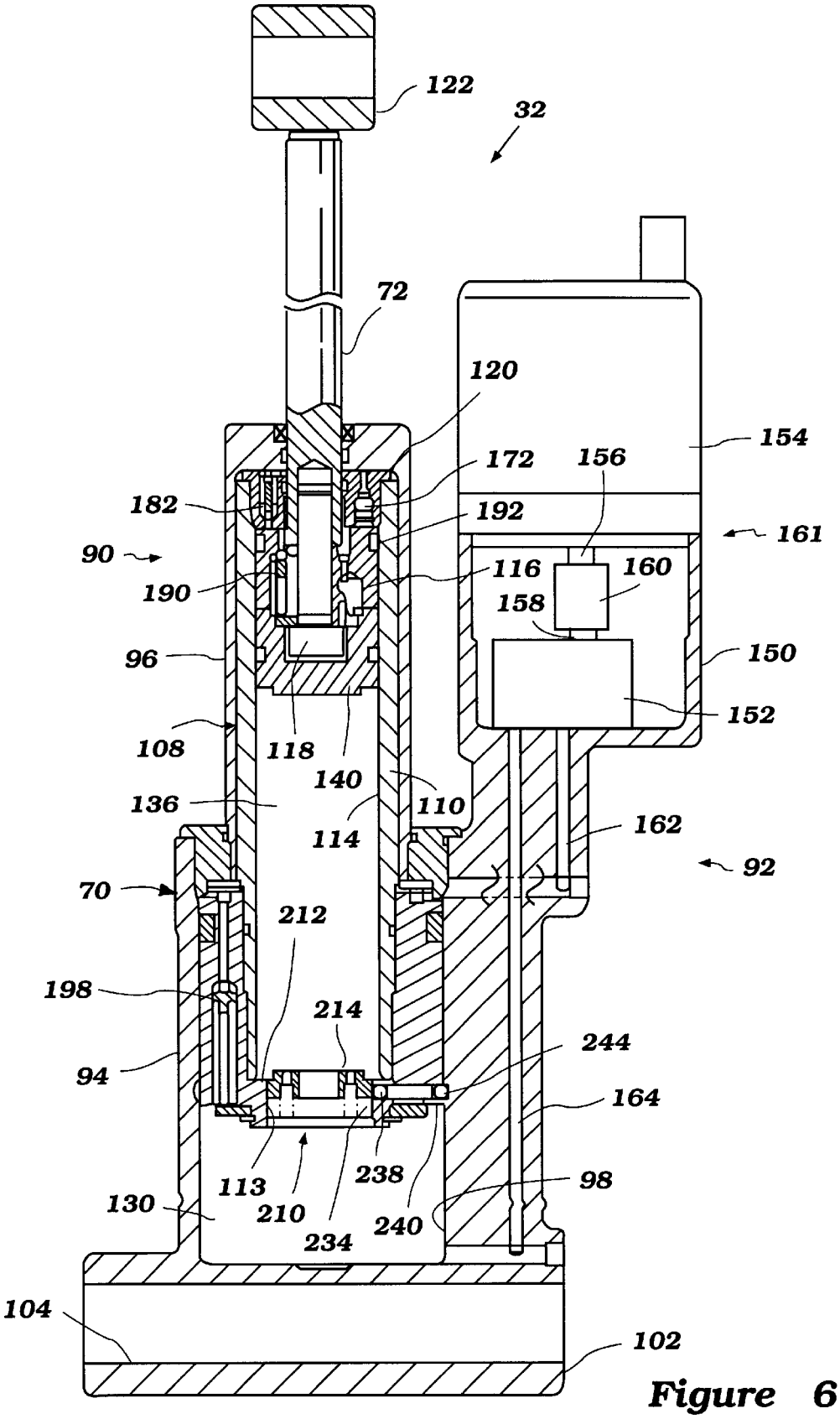
FIG. 6 is an enlarged cross-sectional front view showing the same system of FIG. 5 in a fully tilted up position.

A tilt cylinder assembly 108 is slidably supported within the first internal cavity 98 reciprocating along the axis C of the outer cylinder 70 like the piston rod 72. The tilt cylinder assembly 108 includes a tilt cylinder member 110 and a trim piston member 111 that is affixed around a bottom section of the tilt cylinder member 110. A seal member 112 on an outer surface of the trim piston member 111 makes a seal engagement with an inner surface of the lower cylinder section 94. The tilt cylinder assembly 108 acts not only as a tilt cylinder, but also as a trim piston. As best seen in FIGS. 5 and 6, a lower opening 113 is formed at the lower end of the tilt cylinder assembly 108, more specifically, the trim piston member 111. A second internal cavity 114 is defined in the tilt cylinder assembly 108. A tilt piston 116 is slidably supported within the second internal cavity 114. A seal member 115 on an outer surface of the tilt piston 116 makes a seal engagement with an inner surface of the tilt cylinder member 110. The piston rod 72 is affixed to the tilt piston 116 with a bolt 118 and extends upwardly beyond both of the second internal cavity 114 and first internal cavity 98. Another cap 120 completes the tilt cylinder assembly 108 and plugs an upper opening formed between the cylinder member 110 and piston rod 72. A seal member 121 (see FIG. 7) is provided on the cap 120 to receive the piston rod 72 in sealing engagement. Another boss 122 is provided atop of the piston rod 72. The pivot shaft 76 extends through an opening 124 of the boss 122. Seal members 126 are provided atop of the upper cylinder section 96 to receive the piston rod 72 in sealing engagement.

When the tilt cylinder assembly 108 and the tilt piston 112 move within the first internal cavity 98 and second internal cavity 114, respectively, several chambers are defined in these cavities 98, 114. The first internal cavity 98 is divided into a first chamber 128 and a second chamber 130 by the tilt cylinder assembly 108. In this illustrated embodiment, the second chamber 130 is again divided by the trim piston member 111 to form a third chamber 132.

The second internal cavity 114 is divided into a fourth chamber 134 and a fifth chamber 136 (see FIG. 5). However, the fifth chamber 134 communicates with the second chamber 130 through the aforenoted lower opening 113, and hence it actually has no difference from the second chamber 130.

In this illustrated embodiment, a floating piston 140 is provided directly below the tilt piston 116. A seal member 142 on an outer surface of the floating piston 140 makes a seal engagement with an inner surface of the tilt cylinder member 110. The floating piston 140 has a pocket 144 in which a head portion of the bolt 118 can be placed. This floating piston 140 usually moves together with the tilt piston 116 under ordinary operations. However, it stays at an initial position separately from the tilt piston 116 on an occasion when an underwater obstacle is struck by the drive unit 34, as described later. That is, the floating piston 140 is a part of the tilt piston 116 on almost every occasion. In addition, this piston 140 is dispensable. The term "tilt piston" in this application may mean a tilt piston including this floating piston part. Although not shown, a sixth chamber is formed between the tilt piston 116 and the floating piston 140, when the floating piston 140 is separated from the tilt piston 116.

A large part of the pressurizing mechanism 92 in this first embodiment is located in the space S1 as shown in phantom line. As noted above, the space S1 is greater than the space S2. Thus, the mechanism 92 may fit into the space S1 more than in the space S2. The pressurizing mechanism 92, the body of which is unified with the lower cylinder section 94 as described above, includes a housing 150. In the illustrated embodiment, the housing 150 is disposed in the proximity of the upper cylinder section 96, side by side. A reversible fluid pump 152 is disposed in the housing 150. Also, a reversible electric motor 154 is mounted on the housing 150. An output shaft 156 of the electric motor 154 and an input shaft 158 of the fluid pump 152 are coupled together by a coupling 160. This coupling is formed within the housing 150. The housing 150, reversible fluid pump 152, reversible electric motor 154 and coupling 160 define a powering assembly 161 in this embodiment.

The fluid pump 152 communicates with the first internal cavity 98 by passages or vessels 162 and 164. The passages 162 and 164 communicate with the third chamber 132 and the second chamber 130, respectively. Plugs 165 are provided to close outside openings. Although a shuttle valve assembly is disposed therebetween it is omitted in FIGS. 3 to 6. An actual fluid circuit, including the shuttle valve assembly, will be described with reference to FIG. 10 shortly.

The third chamber 132 communicates with the first chamber 128 through a plurality of grooves 166 (see FIG. 8) formed on an inner surface of the upper cylinder section 96 of the outer cylinder 70. In other words, the inner surface of the upper cylinder section 96 abuts the outer surface of the tilt cylinder member 110. Since the tilt cylinder member 110 is fitted within the upper cylinder section 96, the respective grooves 166 independently connect the first and third chambers 128, 132 as communicating passages. Since these chambers 128, 132 are joined by these internal grooves 166, no outer passages for joining them are needed. This arrangement can, therefore, contribute to the compactness of the hydraulic system 32. It should be noted that the grooves 166 may be formed on an outer surface of the tilt cylinder member 110.

Still primarily referring to FIGS. 3 to 8, a valving arrangement in the cylinder assembly 90 will be described.

The cap 120 of the tilt cylinder member 110 has a trim-tilt switchover valve arrangement therein. The switchover valve arrangement includes a trim-tilt switchover valve assembly 172 disposed in a passage 174 that joins the first chamber 128 and the fourth chamber 134. The switchover valve assembly 172 includes a ball or check valve element 176 that is biased to a valve seat by a spring 178 for closing the passage 174. The valve assembly 172 further includes an actuating plunger 180 positioned on the opposite side of the spring 178 within the passage 174 and contacts the ball 176. The plunger 180 protrudes to the first chamber 128 inasmuch as the ball 176 is seated on the valve seat. When the tilt cylinder assembly 108 moves upwardly and the actuating plunger 180 touches the upper end of the upper cylinder section 96, the plunger 180 pushes the ball 176 against the biasing force of the spring 178 to open the passage 174 and allow the working fluid in the fourth chamber 134 flowing to the first chamber 128. Under this condition, the tilt piston 116 can move upwardly within the second internal cavity 114. Because of the trim-tilt switchover valve assembly 172, a tilt-up movement will never precede a trim-up movement.

The cap 120 may have a temperature relief valve arrangement therein. In the illustrated embodiment, it is provided and shown in FIGS. 3 to 6 but omitted in FIGS. 7 and 8. The valve arrangement includes a temperature relief valve assembly 182 disposed in a relief passage that joins the first chamber 128 and the fourth chamber 134. The valve assembly 182 includes a ball or check valve element that is biased to a valve seat by a spring for closing the passage. If the fluid in the fourth chamber 134 expands due to being under high temperature condition and its pressure increases greater than a predetermined value, the temperature relief valve assembly 182 allows fluid to flow into the first chamber 128. The valve assembly 182, however, prevents fluid in the first chamber 128 from flowing into the fourth chamber 134. Since the relief valve assembly 182 is provided for the temperature compensation purpose, the passage can be as small as possible.

The tilt piston 116 includes a shock absorber valve arrangement therein. The shock absorber valve arrangement comprises an absorber valve passage, relief valve passage, shock absorber valve 190 and relief valve 192. The shock absorber valve 190 is disposed in the absorber valve passage that joins the fourth chamber 134 and the sixth chamber. The sixth chamber can exist between the tilt piston 116 and the floating piston 140 as noted above. The shock absorber valve 190 includes a ball or check valve element that is biased by a spring to close the absorber valve passage. If extremely large pressure is produced in the fourth chamber 134, i.e., sufficient force is applied, the absorber valve 190 is opened against the biasing force of the spring to allow the working fluid in the fourth chamber 134 flowing to the sixth chamber. The inverse flow from the sixth chamber to the fourth chamber 134 is precluded by the absorber valve 190 anyway. The relief valve 192 is disposed in the relief valve passage that also joins the fourth chamber 134 and the sixth chamber to relieve the working fluid that has flowed into the sixth chamber to the fourth chamber 134. The relief valve 192 includes a ball or check valve element which is not biased by a spring. The relief valve 192 does not permit the fluid in the sixth chamber flow to the fourth chamber 134 anyhow.

Because of such an absorber arrangement in the tilt piston 116, the shock absorber valve 190 permits restricted flow of the working fluid from the first chamber 128 to the fourth chamber 134 so as to permit the drive unit 34 to pop up within the tilt range 82 when an underwater obstacle is struck and if sufficient force is applied to open the shock absorber valve 190. Under this condition, although the tilt piston 116 moves upwardly, the floating piston 140 will remain at a trim adjusted position because the fluid in the sixth chamber has no way to flow out and thus will be confined therein. When the underwater obstacle is cleared, the drive unit 34 may return to the trim adjusted position by fluid flow from the sixth chamber to the fourth chamber 134 through the relief valve passage in which the relief valve 192 is placed.

Although it is quite a rare case, a massive obstacle may be struck and huge force will be abruptly exerted upon the drive unit 34, causing tremendous pressure produced in the fourth chamber 134. If this pressure is beyond the ability of the shock absorber valve 190, the piston rod 72 will be restricted in its rapid upward motion and high pressure will be produced in the first chamber 128. In order to release this high pressure in the first chamber 128, a second shock absorber valve arrangement is provided. This valve arrangement is disposed in the trim piston member 111 of the tilt cylinder assembly 108 because the first chamber 128 communicates with the third chamber 132 at all times through the communication passages defined by the grooves 166.

The second shock absorber valve arrangement comprises a second absorber passage 196 and a second absorber valve 198. The second absorber passage 196 joins the third chamber 132 to the second chamber 130 and the absorber valve 198 is disposed in the second absorber passage 198. The second absorber passage 196 includes a ball or check valve element that is biased by a spring to close the second absorber passage 196. If tremendous pressure is produced in the first chamber 128, it is transferred to the third chamber immediately through the communication passages formed by the grooves 166. This pressure opens the absorber valve 198 against the biasing force by the spring to allow the fluid in the third and first chambers 132, 128 to the second chamber 130. This transfer of the fluid permits the tilt cylinder assembly 70 to move upwardly permitting the drive unit 34 to clear the underwater obstacle more easily. It is desirable that the biasing force for the second absorber valve 198 be greater than the biasing force for the first absorber valve 190.

Figure 9:
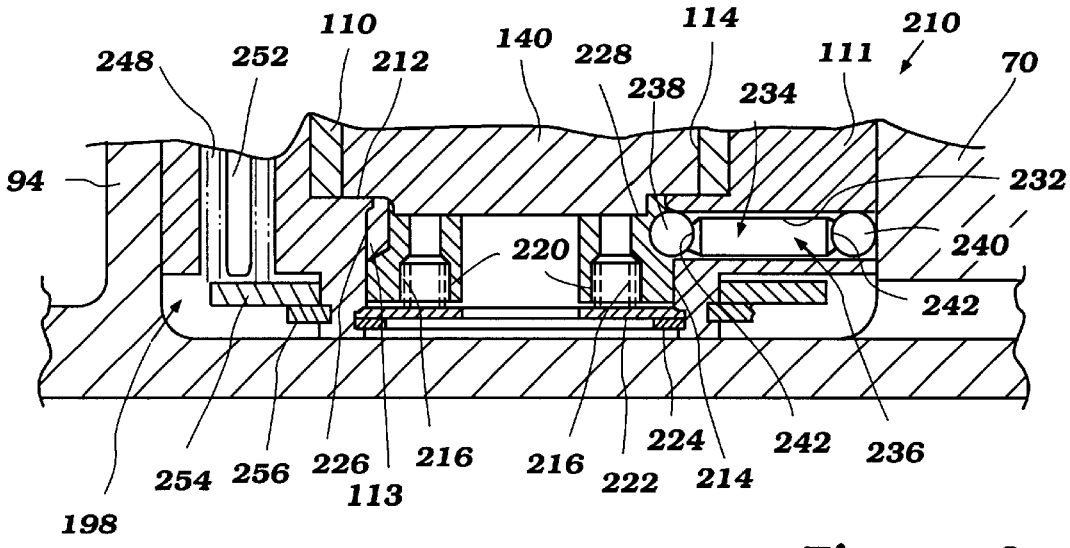
FIG. 9 is a partially enlarged view showing a latching mechanism employed in the telescopic tilt and trim system.

As described above, there is a need to preclude a trim-down movement from preceding a tilt-down movement. A detent mechanism 210 for this purpose in this embodiment as illustrated in FIG. 9. The trim piston member 111 of the tilt cylinder assembly 108 has the lower opening 113 as noted above. The lower opening 113 extends generally along an axis of the tilt cylinder assembly 108, and its diameter is smaller than a diameter of the second internal cavity 114. A circular step 212 is, therefore, formed therebetween. The lower end of the floating piston 140, as a part of the tilt piston 116, is seated when the tilt piston 116 is placed at its fully retracted position with respect to the tilt cylinder assembly, i.e., the drive unit 34 is in the fully trimmed down position. That is, a reaction force of the floating piston 140 and tilt piston 116 that bear the whole weight of the drive unit 34 is received directly by the tilt cylinder assembly 108 instead of, for example, a snap ring. The circular step 212, thus, defines a reaction force receiving section.

A latching or pushing member 214 slidably fits in the opening 113. A plurality of recesses 216 are disposed circularly at its lower surface. A plurality of springs 220 fit within the recesses 216. The springs 220 are held by a spring retainer 222 that is prevented from slipping out by a stopper or snap ring 224. The latching member 214 is biased upwardly by the springs 220 and enabled to contact a projecting portion 226 of the floating piston 140 that extends from the lowermost end thereof. In other words, the latching member 214 is movable between an upper position and a lower position. In the situation illustrated in FIG. 9, the latching member 214 is in the lower position because the floating piston 140 is seated at the step portion 212 and pushes the latching member 214 downwardly by its projecting portion 226. When the floating piston 140 moves upwardly with the tilt piston 116, the latching member 214 moves to the upper position by the biasing force of the springs 216. The latching member 214 has a circular recess 228 at its upper end.

The lower end portion of the trim piston member 111 has a plurality of openings 232 which extend generally horizontally, radially and normal to the axis of the tilt cylinder assembly 108. When the latching member 214 is in the lower position, its circular recess 228 can meet the openings 232. A plurality of detent units 234 are slidably supported within the horizontal openings 232. Each detent unit 234 in the illustrated embodiment includes a pin 236 and a couple of detent balls, i.e., an inner ball 238 and an outer ball 240, disposed at both ends of the pin 236. More specifically, the balls 238, 240 are seated at ball seats 242 formed at the ends of the pin 236. Other constructions are available inasmuch as both ends of the detent unit 234 have convex surfaces such as, for example, a single pin that has the convex surfaces.

The inner balls 238 can fit in the circular recess 228 of the latching member 214 when the latching member 214 is in the lower position, because the horizontal openings 232 meet the circular recess 228 as seen in FIG. 9. In addition, at this position, the outer balls 240 are confined in the horizontal openings 232 by the internal wall of the lower cylinder section 94. Since the whole length of each detent unit 234 is selected to be equal to the sum of the length of the horizontal opening 232 and the depth of the circular recess 238, each inner ball 238 fits in the circular recess 228.

As seen in FIGS. 3 to 6, the internal wall of the lower cylinder section 94 has another circular recess 244 where the detent units 240 may position when the drive unit 34 is in the fully trimmed up position. When the tilt cylinder assembly 108 is moving up from the deepest position or the fully trimmed down position to the fully trimed up position (see FIG. 4), the detent units 234 continue to stay in the state described above. However, at the very moment, the floating piston 140, as well as the tilt piston 116, starts moving upwardly, the latching member 224 will transfer to the upper position by the biasing force of the springs 220. This snap action causes the circular recess 228 to move away from the horizontal openings 232; and instead the lower portion, which has a diameter larger than the circular recess 228, of the latching member 214 confronts the openings 232. Because of this, the detent units 234 are shifted outwardly and the outer balls 240 fit in the circular recess 244 of the lower section 94. Once the outer detent balls 240 are in the circular recess 244, the tilt cylinder assembly 108 is locked at this position, because the lower portion of the latching member 214 holds the inner balls 238 out of the circular recess 228 of the latching member 214.

Members partially seen at the left-hand side of FIG. 9 are components of the second absorber valve 198. The spring, which is now designated by the reference numeral 248, biases the ball 250 (see FIG. 3) via a retainer 252. The spring 248 is held by a circular spring retainer 254. The spring retainer 254, in turn, is supported around the lower end of the trim piston member 111 of the tilt cylinder assembly 108 by a stopper or snap ring 256.

Figure 10:
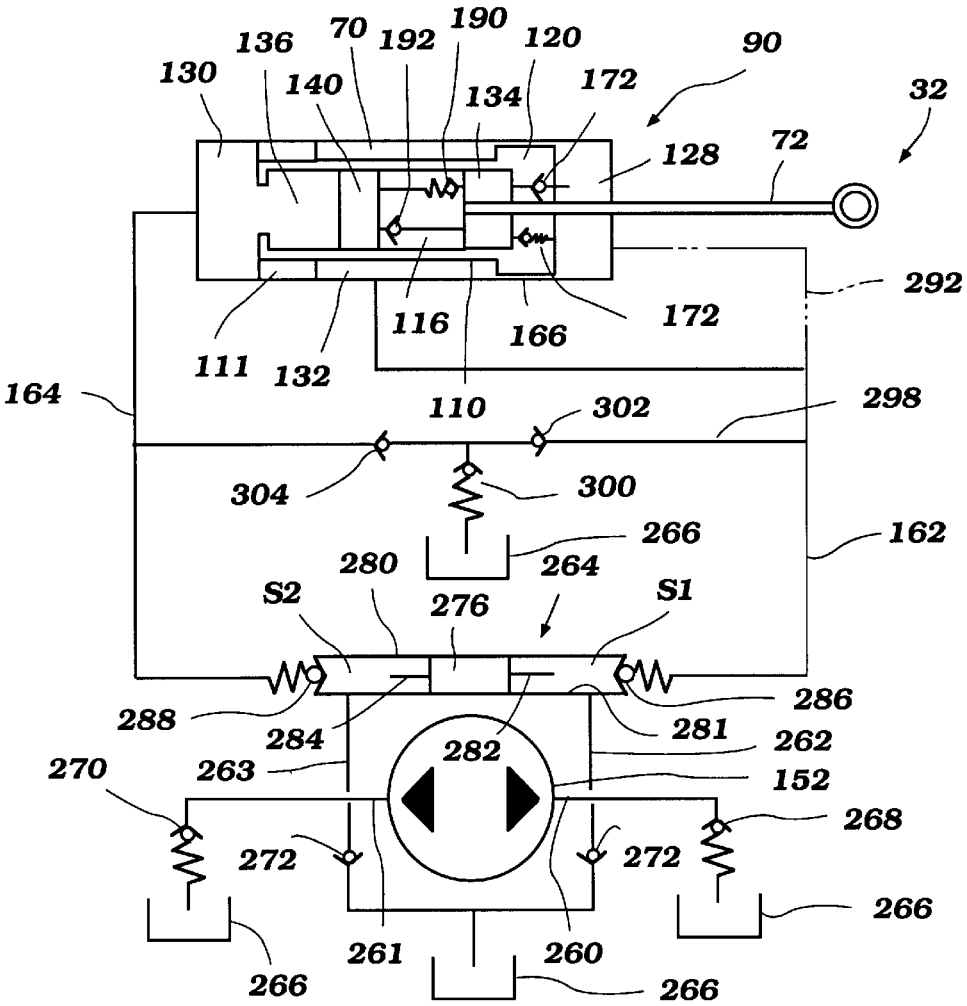
FIG. 10 is a hydraulic circuit of the cylinder arrangement.

The telescopic cylinder assembly 90 is operated by the pressurizing mechanism 92. With reference to FIG. 10, an exemplary fluid circuit for this operation will now be described. The telescopic cylinder assembly 90 is rather schematically shown and the second absorber valve 198 is omitted in FIG. 10.

The reversible fluid pump 152, which is activated by the reversible electric motor 154, has a couple of inlet-outlet ports 260, 261 that are connected to a couple of inlet ports 262, 263 of the aforenoted shuttle valve assembly, which is now designated by the reference numeral 264. The respective inlet-outlet ports 260, 261 of the reversible fluid pump 152 are also connected to a fluid reservoir 266 through an up-relief valve 268, down-relief valve 270 and check valves 272. The respective relief valves 268, 270 are provided for relieving surplus fluid to the reservoir 266, while the check valves 272 are provided for compensating for deficiency of fluid from the reservoir 266.

The shuttle valve assembly 264 includes a shuttle piston 276 slidably supported in a shuttle cylinder 280. The shuttle cylinder defines an internal cavity 281 that is divided into two fluid chambers S1 and S2. The shuttle piston 276 has projections 282 and 284 at its both sides. A pair of shuttle valves 286 and 288 are provided at the ends of the shuttle cylinder 280 to close those ends. The shuttle valves 286, 288 are enabled to be opened by the projections 282, 284 when the shuttle piston 276 moves toward the valves 286, 288. As noted above, the shuttle valve 286 is connected primarily to the third chamber 132 of the cylinder assembly 32 through the passage or fluid line 162 and then finally connected to the first chamber 128 through the grooves 166 (see FIG. 8). However, it is of course applicable to connect the shuttle valve 286 directly to the first chamber 128 through a fluid line 292 indicated in phantom. The shuttle valve 288, in turn, is connected to the second chamber 130 through the passage or fluid line 164.

Both of the fluid lines 162 and 164 are joined together by another fluid line 298. The line 298 is connected to the fluid reservoir 266 by a manual valve 300 that only allows the fluid flowing to the reservoir 266. A pair of check valves 302 and 304 are provided between the manual valve 300 and the respective fluid lines 162, 164. These check valves 302, 304 permit the fluid to flow to the manual valve 300 but prevent inverse flow. The manual valve 300 is manually operated by the operator if the operator desire to lift or lower the drive unit 34 without activating the powering assembly 161.

When the reversible fluid pump 152 is activated, under the condition that the manual valve 300 is closed, by the reversible electric motor 154, for example, to supply fluid toward the first chamber 128, the fluid is put out from the inlet-outlet port 260 and introduced into the fluid chamber S1 of the shuttle cylinder 280. This fluid itself pushes the shuttle valve 286 to open it and simultaneously moves the shuttle piston 276 toward the other shuttle valve 288. The projection 284 of the shuttle piston 276 pushes the shuffle valve 288 and opens it also. The fluid, therefore, goes to the third chamber 132 through the fluid line 162 and finally reaches the first chamber 128 through the grooves 166 and then pushes the tilt cylinder assembly 108 down. Meanwhile, the fluid in the second chamber 130 can go to the fluid chamber S2 of the shuttle cylinder 280 through the fluid line 164 under the condition that the shuttle valve 288 is opened and finally goes to the fluid pump 152. Thus, the tilt cylinder assembly 108 moves downwardly to lower down the drive unit 34. In a similar manner, a reverse operation will be given when the fluid pump 152 is operated in the other direction.

With reference to FIGS. 1 to 10, the total operations of the telescopic tilt and trim hydraulic system 32 will now be described.

Figure 3:
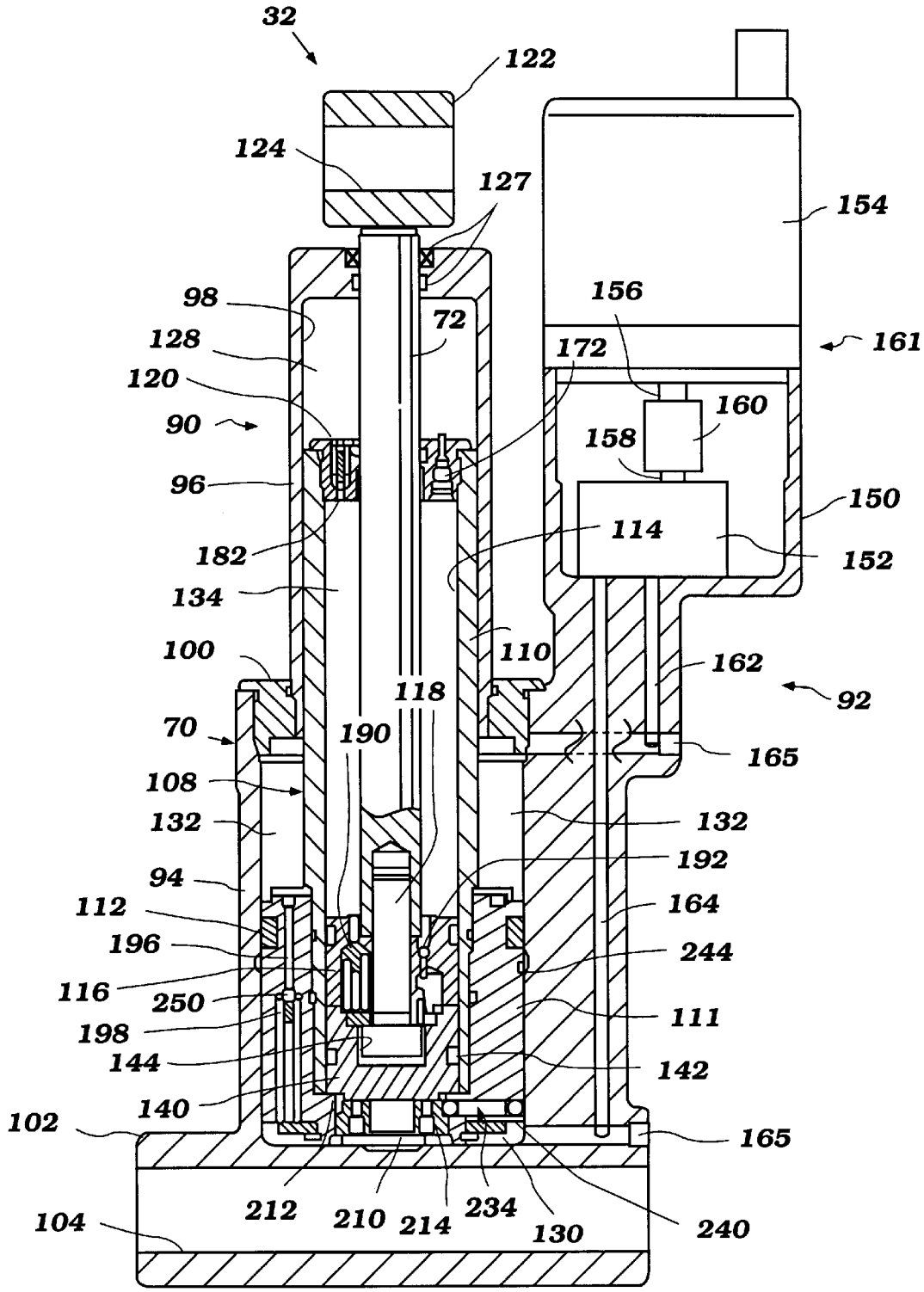
FIG. 3 is an enlarged cross-sectional front view showing a telescopic tilt and trim hydraulic system in accordance with a first embodiment of the present invention. The system is in a fully trimmed down position.

Initially, the tilt cylinder assembly 108 and the tilt piston 116 including the floating piston 140 of the hydraulic system 32 are in their deepest positions as shown in FIG. 3. When they are in these positions, the drive unit 34 is placed at the fully trimmed down position as shown in FIG. 1. The detent mechanism 210 is in the state shown in FIGS. 3 and 9, and the detent balls 238 are latched at the circular recess 228 of the latching member 214.

Figure 4:
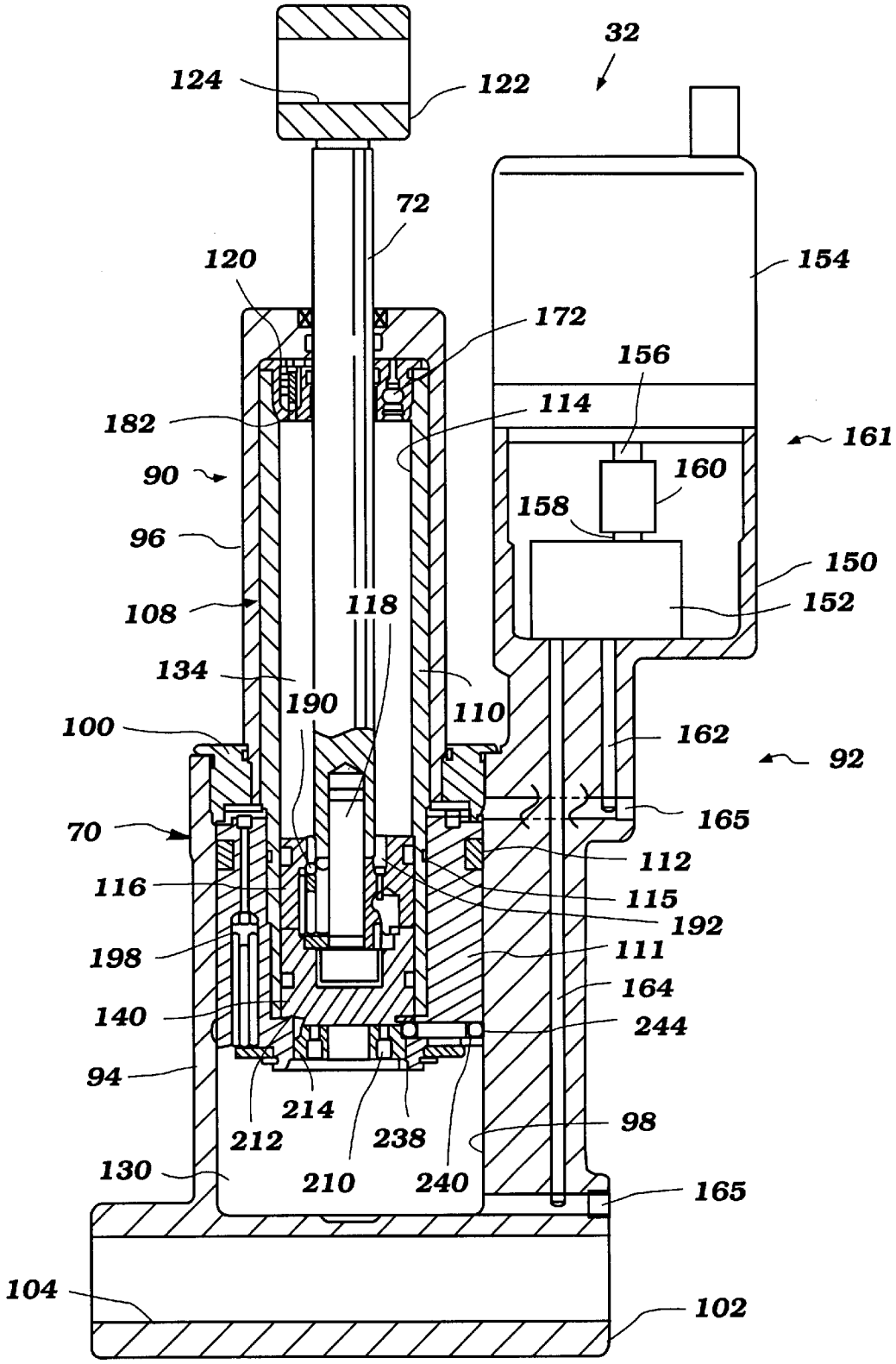
FIG. 4 is an enlarged cross-sectional front view showing the system of FIG. 3 in a fully trimmed up position.

When the working fluid is supplied to the second chamber 130 through the fluid line 164 by the activities of the electric motor 154, fluid pump 152 and the shuttle valve assembly 264 as noted above, the tilt cylinder assembly 108 starts moving upwardly. The fluid in the fourth chamber 134 is trapped therein because the trim-tilt switchover assembly 172 is closed and hence the tilt piston 116 will stay as it is in the internal cavity 114 of the tilt cylinder assembly 108. The fluid in the first chamber 128 may return to the fluid pump 152 through the grooves 166, fluid line 162 and the shuttle valve assembly 264. The tilt piston assembly 108 reaches the fully tried up position, as shown in FIG. 4.

Figure 7:
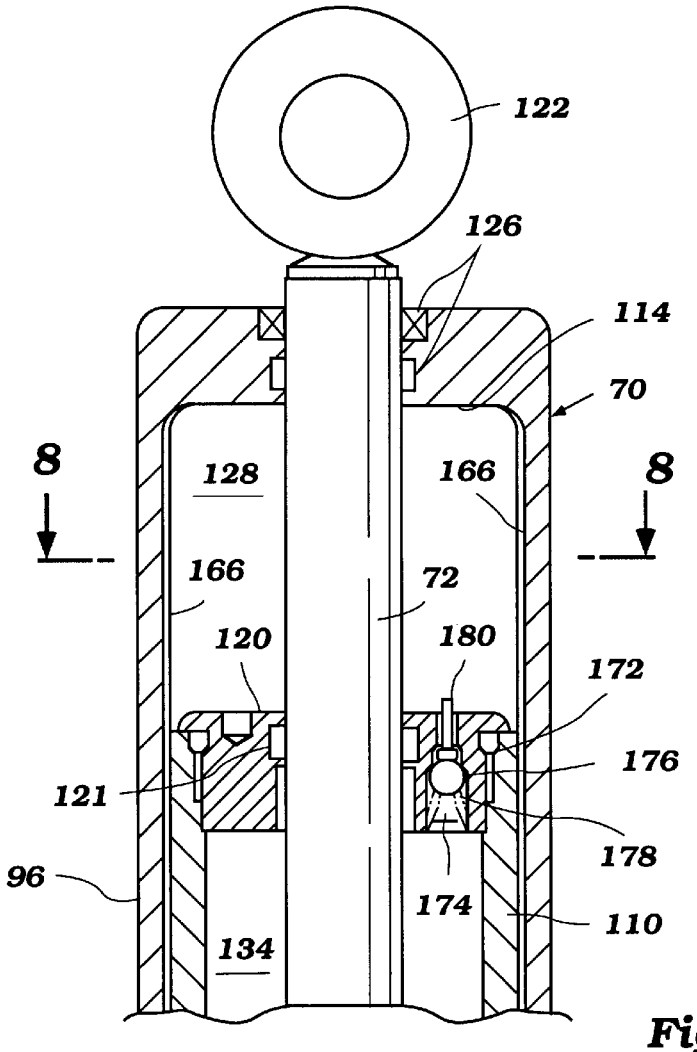
FIG. 7 is a partially enlarged view showing a top portion of the system of FIG. 5 and particularly a cap of a tilt cylinder of the system.
Figure 8:
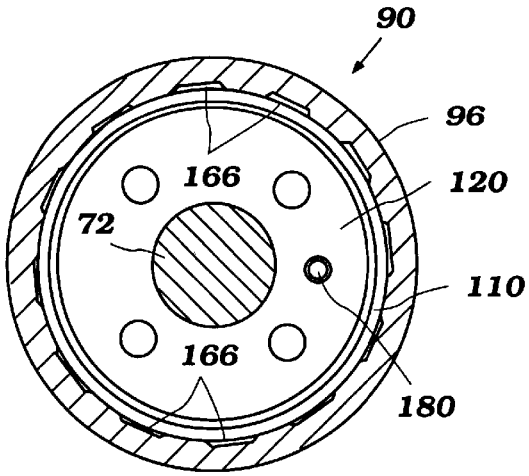
FIG. 8 is a cross-sectional view taken along the line 8—8 in FIG. 7 to show a top plan view of the cap and internal passages that communicate internal cavities of the system.

In this position, the actuating plunger 180 of FIG. 7 pushes the ball 176 to open the switchover valve assembly 172 against the biasing force of the spring 178. The fluid in the fourth chamber 134, then, flows into the first chamber 128 through the passage 174. This flow of the fluid permits the tilt piston 116 with the floating piston 140 to move upwardly in the cavity 114. The fluid that pressurizes the tilt piston 116 and the floating piston 140 is supplied to the fifth chamber 136 from the second chamber 130 through the lower opening 113. At this moment, the detent units 234 are pushed outwardly because the latching member 214 is moved upwardly by the biasing force of the springs 216. Since the circular recess 244 of the trim piston member 111 faces the detent units 234 at this very position, the detent ball 240 is snapped into the recess 244 and urged to stay there by the latching member 214.

If the fluid pump 152 still operates, the tilt piston 116 continues to move up. This situation is shown in FIG. 5. Then, the tilt piston 116 finally reaches the uppermost position as shown in FIG. 6. When the tilt piston 116 is in this position, the drive unit 34 is placed at the fully tilted up position as shown in FIG. 2.

When the working fluid is supplied to the first chamber 128 in this state through the fluid line 162 and grooves 166, the tilt piston 116 moves down. The detent mechanism 210, however, still stays in the situation that the detent ball 240 is latched in the recess 244. Thus, the tilt cylinder assembly 108 stays also at the uppermost position in the internal cavity 98 of the outer cylinder 96 and only the tilt piston 116 as well as the floating piston 140 moves down. In other words, the trim down operation of the drive unit 34 will never happen and only the tilt down operation thereof can continue in this situation.

When the tilt piston 116 and floating piston 140 reach the lowermost position in the cavity 114 of the tilt cylinder assembly 108, the floating piston 140 touches the latching member 214 to put it down against the biasing force of the springs 216. The detent ball 238 is now engageable with the circular recess 140 of the latching member 214 and the detent unit 234 is snapped out inwardly because the detent ball 244 is pushed out from the circular recess 244 of the lower cylinder section 94. Thus, the tilt cylinder assembly 108 is enabled to move down toward the deepest position in the internal cavity 98 of the outer cylinder 96 and the drive unit 34 is allowed to return back to the fully trimmed down position.

As described above, the detent mechanism 210 is formed at the trim piston member 111 of the tilt cylinder assembly 108. Also, the reaction force of the floating piston 140 and tilt piston 116 that bear whole weight of the drive unit 34 is received by the circular step 212 of the trim piston member 111. Since both of the latching mechanism 210 and the reaction force receiving section defined by the circular step 212 are formed at the same member, the construction is simple and neat. In addition, the reaction force is received directly by the step 212 of the trim piston member 111, even enormous force can be received that may not be received by a snap ring that is used conventionally.

Another telescopic tilt and trim hydraulic system in accordance with the second embodiment of the present invention is illustrated in FIGS. 12 to 15. The only difference from the first embodiment is that the pressurizing mechanism is positioned lower than the position in the first embodiment. Because, this embodiment is to show that the pressurizing mechanism can be located in the space S2 shown in FIG. 11, if this space S2 is sufficient for the mechanism. The same members and components of the hydraulic system that are already described with the first embodiment in referring to FIGS. 1 to 11 are, therefore, assigned with the same reference numerals and not described again.

In FIG. 11, an electric cable 310 is provided for the electric motor 154. This cable 310 is of course provided on the electric motor 154 in the first embodiment.

Of course, the foregoing description is that of preferred embodiments of the invention, and various changes and modifications may be made without departing from the spirit and scope of the invention, as defined by the appended claims.

What is claimed is:

1. A telescopic tilt and trim hydraulic system for a watercraft and an outboard drive comprising an outer cylinder adapted to be affixed to one of the watercraft and the outboard drive and defining a first internal cavity, a tilt cylinder assembly slidably supported within said first internal cavity and defining a second internal cavity, a tilt piston slidably supported within said second internal cavity, a piston rod affixed to said tilt piston and extending beyond said internal cavities for attachment to the other of the outboard drive and the watercraft, a pressurizing mechanism arranged to selectively pressurize working fluid within said first cavity and said second cavity for causing reciprocal movement of said tilt cylinder assembly for effecting trim adjustment of said outboard drive and reciprocal movement of said tilt piston for effecting tilt movement of said outboard drive, and a latching mechanism arranged to latch said tilt cylinder assembly at generally a fully tilted up position, said tilt piston being configured so that a load on said piston in its fully retracted position in said tilt cylinder assembly is transferred directly to said tilt cylinder assembly.

2. The system of claim 1, wherein said tilt cylinder assembly includes a member on its lower end having an inwardly extending shoulder which is engaged by said piston when in said fully retracted position.

3. The system of claim 2, wherein said tilt cylinder assembly includes a cylinder member and a trim piston member affixed to a lower end of said cylinder member, said shoulder being formed on said trim piston.

4. The system of claim 2, wherein said latching mechanism includes a detent unit latched to said member below said shoulder and arranged to move into locking engagement with said outer cylinder when said tilt cylinder assembly is in said fully tilted up position.

5. A telescopic tilt and trim hydraulic system as set forth in claim 4, wherein said tilt cylinder includes an opening extending generally along the axis of said tilt cylinder, a latching member slidably supported in said opening, and said latching member has a detent recess in which said detent unit is engageable.

6. A telescopic tilt and trim hydraulic system as set forth in claim 5, wherein said latching member is movable between a first position and a second position, said detent unit engages said latching member when said latching member is placed at the first position, and said detent unit disengages with said latching member when said latching member is placed at the second position.

7. A telescopic tilt and trim hydraulic cylinder system as set forth in claim 6, wherein said latching member is placed at the first position when said tilt piston is placed at the fully retracted position.

8. A telescopic tilt and trim hydraulic cylinder system as set forth in claim 7, wherein said tilt cylinder assembly holds means for biasing said latching member toward the second position.

9. A telescopic tilt and trim hydraulic system as set forth in claim 4, wherein said tilt cylinder assembly includes a plurality of openings extending generally radially and normal to an axis of said tilt cylinder, and a plurality of said detent units are slidably supported therein.

10. A telescopic tilt and trim hydraulic cylinder system as set forth in claim 1, wherein said tilt cylinder assembly includes a tilt cylinder member and a trim piston member affixed to said tilt cylinder member.

11. A telescopic tilt and trim hydraulic system as set forth in claim 10, including a latch mechanism including a member carried by said trim piston member.

12. A telescopic tilt and trim hydraulic system as set forth in claim 1, wherein said outer cylinder is affixed to the watercraft and said piston rod is affixed to the outboard drive, said outer cylinder includes an upper section and a lower section, said pressurizing mechanism includes a powering assembly, and said powering assembly is disposed in proximity to said upper section of said outer cylinder.

13. A telescopic tilt and trim hydraulic system as set forth in claim 1, wherein at least one fluid passage is defined between said tilt cylinder and said upper section of said outer cylinder, and said fluid passage communicates with both of said first cavity and said second cavity.

14. A telescopic tilt and trim hydraulic system for a watercraft and an outboard drive comprising an outer cylinder adapted to be affixed to the watercraft and defining a first internal cavity, said outer cylinder including an upper section and a lower section, said lower section being thicker than said upper section of said outer cylinder, a tilt cylinder slidably supported within said first internal cavity and defining a second internal cavity, a tilt piston slidably supported within said second internal cavity, a piston rod affixed to said tilt piston and extending beyond said internal cavities for attachment to the outboard drive, a pressurizing mechanism arranged to selectively pressurize working fluid within said first cavity and said second cavity for causing reciprocal movement of said tilt cylinder for effecting trim adjustment of said outboard drive and reciprocal movement of said tilt piston for effecting tilt movement of said outboard drive, said pressurizing mechanism including a powering assembly, and said powering assembly being disposed in proximity to said upper section of said outer cylinder.

15. A telescopic tilt and trim hydraulic system as set forth in claim 14, wherein said powering assembly has a hydraulic pump and an electric motor activating said hydraulic pump, and said hydraulic pump and said electric motor are spaced generally vertically relative to each other.

16. A telescopic tilt and trim hydraulic system as set forth in claim 14, wherein said powering assembly is unified with said lower section of said outer cylinder.

17. A telescopic tilt and trim hydraulic system as set forth in claim 16, wherein said pressurizing mechanism includes vessels arranged to connect said powering assembly with said first and second cavities.

18. A telescopic tilt and trim hydraulic system as set forth in claim 14 additionally comprising a support member arranged to affix said outer cylinder to the watercraft, said support member including a pair of bracket arms spaced apart from each other, said outer cylinder being nested between said bracket arms, each of said bracket arms has a standing section, upper portions of said standing sections are spaced apart farther from each other than lower portions thereof, and said powering assembly is placed generally between the upper portions.

19. A telescopic tilt and trim hydraulic cylinder system as set forth in claim 14, wherein said tilt cylinder includes a tilt cylinder member and a trim piston member affixed to said tilt cylinder member, and said trim piston member is placed within said lower section of said outer cylinder.

20. A telescopic tilt and trim hydraulic system as set forth in claim 14, wherein at least one fluid passage is defined between said tilt cylinder and said upper section of the outer cylinder, and said fluid passage communicates with both of said first cavity and said second cavity.

21. A telescopic tilt and trim hydraulic system as set forth in claim 20, wherein said fluid passage is formed on an inner surface of said outer cylinder.

22. A telescopic tilt and trim hydraulic system as set forth in claim 14 additionally comprising a support member arranged to affix said outer cylinder to the watercraft, said support member including a pair of bracket arms spaced apart from each other, a center axis of said support member extending therein with generally the same distances from said bracket arms, and said outer cylinder being nested between said bracket arms.

23. A telescopic tilt and trim hydraulic system as set forth in claim 22, wherein said powering assembly being positioned oppositely to said outer cylinder relative to said center axis of said support member.

24. A telescopic tilt and trim hydraulic system for a watercraft and an outboard drive comprising an outer cylinder adapted to be affixed to one of the watercraft and the outboard drive and defining a first internal cavity, a tilt cylinder slidably supported within said first internal cavity and defining a second internal cavity, a tilt piston slidably supported within said second internal cavity, a piston rod affixed to said tilt piston and extending beyond said internal cavities for attachment to the other of the outboard drive and the watercraft, a pressurizing mechanism arranged to selectively pressurize working fluid within said first cavity and said second cavity for causing reciprocal movement of said tilt cylinder for effecting trim adjustment of said outboard drive and reciprocal movement of said tilt piston for effecting tilt movement of said outboard drive, said pressurizing mechanism including at least one fluid passage defined between said tilt cylinder and said upper section of the outer cylinder, and said fluid passage communicating with both of said first cavity and said second cavity.

25. A telescopic tilt and trim hydraulic system as set forth in claim 24, wherein said fluid passage is formed on an inner surface of said outer cylinder.

26. An outboard motor comprising a drive unit, a swivel bracket arranged to carry the drive unit for pivotal movement about a first pivot axis extending generally vertically, a clamping bracket arranged to support the swivel bracket for pivotal movement about a second pivot axis extending generally horizontally, an outer cylinder coupled to one of the swivel bracket and the clamping bracket for pivotal movement and defining a first internal cavity, a tilt cylinder assembly slidably supported within the first internal cavity and defining a second internal cavity, a tilt piston slidably supported within the second internal cavity, a piston rod affixed to the tilt piston and extending beyond the internal cavities for pivotal attachment to the other one of the swivel bracket and the clamping bracket, a pressurizing mechanism arranged to selectively pressurize working fluid within the first cavity and the second cavity to cause reciprocal movement of the tilt cylinder assembly for effecting trim adjustment of the outboard drive and reciprocal movement of the tilt piston for effecting tilt movement of the outboard drive, and a latching mechanism arranged to latch the tilt cylinder assembly at generally a fully tilted up position, the tilt piston being configured so that a load on the piston in its fully retracted position in the tilt cylinder assembly is transferred directly to the tilt cylinder assembly.

27. A power tilt and trim adjustment mechanism for an outboard drive comprising a support member that couples to said outboard drive, said support member including a pair of bracket arms spaced apart from each other, a center axis of said support member extending therein with generally the same distances from said bracket arms, an actuator having an axis along which at least one actuator element reciprocates, the axis of said actuator being off set from the center axis of said support member, said actuator being nested between said bracket arms, and a powering assembly arranged next to an upper portion of said actuator, said powering assembly being unified with said actuator at an lower portion of said actuator.

28. A telescopic hydraulic system comprising an outer cylinder member, an inner cylinder member slidably supported in said outer cylinder member, said outer cylinder member and said inner cylinder member together defining at least one variable volume fluid chamber with reciprocal movement of said inner cylinder member within said outer cylinder member, a fluid passage formed on at least one of abutting walls of said outer cylinder member and said inner cylinder member, and a powering unit supplying a working fluid to said variable volume fluid chamber through said fluid passage.

29. A method of making a telescopic tilt and trim hydraulic system for a watercraft and an outboard drive comprising the steps of providing an outer cylinder adapted to be affixed to one of the watercraft and the outboard drive and defining a first internal cavity, slidably supporting a tilt cylinder assembly within said first internal cavity to define a second internal cavity, slidably supporting a tilt piston within said second internal cavity, affixing a piston rod to said tilt piston and extending it beyond said internal cavities for attachment to the other of the outboard drive and the watercraft, providing a pressurizing mechanism arranged to selectively pressurize working fluid within said first cavity and said second cavity for causing reciprocal movement of said tilt cylinder assembly for effecting trim adjustment of said outboard drive and reciprocal movement of said tilt piston for effecting tilt movement of said outboard drive, providing a latching mechanism arranged to latch said tilt cylinder assembly at generally a fully tilted up position, and configuring said tilt piston so that a load on said piston in its fully retracted position in said tilt cylinder assembly is transferred directly to said tilt cylinder assembly.

30. The method of claim 29, including providing said tilt cylinder assembly with a an inwardly extending shoulder on its lower end which is engaged by said piston when in said fully retracted position.

31. The method of claim 30, wherein said tilt cylinder assembly includes a cylinder member and a trim piston member affixed to a lower end of said cylinder member, and including the step of providing said shoulder on said trim piston.

32. The method of claim 30, including the steps of slidably supporting a latching member in an opening defined by said shoulder, said latching member being movable between a first position in which it is engaged by said tilt piston in its fully retracted position and receives a detent unit, and a second position in which said tilt piston has extended and said latching member holds the detent unit in a latching position with respect to said outer cylinder.

33. An outboard motor comprising a drive unit, a swivel bracket arranged to carry the drive unit for pivotal movement about a first axis extending generally vertically, a clamping bracket arranged to support the swivel bracket for pivotal movement about a second axis extending generally horizontally, an outer cylinder coupled to the clamping bracket for pivotal movement and defining a first internal cavity, the outer cylinder including an upper section and a lower section, the lower section being of a larger diameter than the upper section of the outer cylinder, a tilt cylinder slidably supported within the first internal cavity and defining a second internal cavity, a tilt piston slidably supported within the second internal cavity, a piston rod affixed to the tilt piston and extending beyond the internal cavities for pivotal attachment to the swivel bracket, a pressurizing mechanism arranged to selectively pressurize working fluid within the first cavity and the second cavity for causing reciprocal movement of the tilt cylinder for effecting trim adjustment of the outboard drive and reciprocal movement of the tilt piston for effecting tilt movement of the outboard drive, the pressurizing mechanism including a powering assembly, and the powering assembly being disposed in proximity to the upper section of the outer cylinder.

34. An outboard motor comprising a drive unit, a swivel bracket arranged to carry the drive unit for pivotal movement about a first axis extending generally vertically, a clamping bracket arranged to support the swivel bracket for pivotal movement about a second axis extending generally horizontally, an outer cylinder coupled to one of the swivel bracket and the clamping bracket for pivotal movement and defining a first internal cavity, a tilt cylinder slidably supported within the first internal cavity and defining a second internal cavity, a tilt piston sidably supported within the second internal cavity, a piston rod affixed to the tilt piston and extending beyond the internal cavities for pivotal attachment to the other one of the swivel bracket and the clamping bracket, a pressurizing mechanism arranged to selectively pressurize working fluid within the first cavity and the second cavity for causing reciprocal movement of the tilt cylinder for effecting trim adjustment of the outboard drive and reciprocal movement of the tilt piston for effecting tilt movement of the outboard drive, the pressurizing mechanism including at least one fluid passage defined between the tilt cylinder and the upper section of the outer cylinder, and the fluid passage communicating with both of the first cavity and the second cavity.

35. An outboard motor comprising a drive unit, a swivel bracket arranged to carry the drive unit for pivotal movement about a first axis extending generally vertically, a clamping bracket arranged to support the swivel bracket for pivotal movement about a second axis extending generally horizontally, the clamping bracket including a pair of bracket arms spaced apart from each other, a center axis of the clamping bracket extending therein with generally the same distances from the bracket arms, an actuator having an axis along which at least one actuator element reciprocates, the axis of the actuator being off set from the center axis of the clamping bracket, the actuator being nested between the bracket arms, and a powering assembly arranged next to an upper portion of the actuator, the powering assembly being unified with the actuator at an lower portion of the actuator.

* * * * *